US009271539B2

(12) United States Patent
Karandonis

(10) Patent No.: US 9,271,539 B2
(45) Date of Patent: Mar. 1, 2016

(54) FOOTWEAR

(76) Inventor: John Fotis Karandonis, Fairlight (AU)

( * ) Notice: Subject to any disclaimer, the term of this patent is extended or adjusted under 35 U.S.C. 154(b) by 680 days.

(21) Appl. No.: 13/370,105

(22) Filed: Feb. 9, 2012

(65) Prior Publication Data

US 2012/0204445 A1 Aug. 16, 2012

(30) Foreign Application Priority Data

Feb. 10, 2011 (AU) ..... 2011900429

(51) Int. Cl.

| | |
|---|---|
| ***A43C 11/12*** | (2006.01) |
| ***A43B 3/00*** | (2006.01) |
| ***A43B 3/06*** | (2006.01) |
| ***A43B 3/14*** | (2006.01) |
| ***A43C 11/00*** | (2006.01) |

(52) U.S. Cl.
CPC ... *A43B 3/06* (2013.01); *A43B 3/14* (2013.01); *A43C 11/008* (2013.01); *A43C 11/12* (2013.01)

(58) Field of Classification Search
CPC ..... A43B 3/30; A43B 3/14; A43B 3/10; A43B 3/106; A43B 13/26
USPC ..... 36/11, 9 R, 10, 112, 50.1
See application file for complete search history.

(56) References Cited

U.S. PATENT DOCUMENTS

| | | | | |
|---|---|---|---|---|
| 362,607 | A * | 5/1887 | Hall | 111/71 |
| 2,598,217 | A * | 5/1952 | Bronson | 36/110 |
| 3,106,790 | A * | 10/1963 | Zimmon | 36/9 R |
| 3,589,038 | A * | 6/1971 | Sailer | 36/50.1 |
| 3,744,163 | A * | 7/1973 | Simister | 36/97 |
| 4,114,297 | A | 9/1978 | Famolare, Jr. | |
| 4,599,811 | A * | 7/1986 | Rousseau | 36/105 |
| 6,973,742 | B2 * | 12/2005 | Gordon | 36/7.1 R |
| 8,371,042 | B2 * | 2/2013 | Matalon | 36/9 R |
| 2004/0128862 | A1 | 7/2004 | Flack | |

FOREIGN PATENT DOCUMENTS

| | | |
|---|---|---|
| DE | 4216336 | 11/1993 |

* cited by examiner

*Primary Examiner* — Jila M Mohandesi
(74) *Attorney, Agent, or Firm* — Shutts & Bowen LLP

(57) ABSTRACT

Footwear is disclosed having an upper secured to a sole and defining at least a front portion. An apron portion having first and second lateral portions and a lower end, each of the first and second lateral portions including a free lateral outer edge can be attached at the lower end to the front portion. A first fastener for releasably connecting the first and second lateral portions together is also provided, the first fastener being configurable between a fastened position in which the first and second lateral portions are held adjacent one another, and an unfastened position in which at least an upper portion of each of the first and second lateral portions, respectively, can be readily separated.

7 Claims, 7 Drawing Sheets

FOOTWEAR

FIELD OF THE INVENTION

The present invention relates to footwear and in particular to enclosed-style footwear that may be easily placed on or removed from a foot of a wearer.

The invention has been developed primarily for use in the manufacturing of moccasins and will be described hereinafter with reference to this application. However, it will be appreciated that the invention is not limited to this particular field of use.

BACKGROUND OF THE INVENTION

Enclosed-style footwear such as moccasins typically comprise an upper that defines an opening to receive a wearer's foot in use. The size of the opening however, is oftentimes only just large enough to receive the wearer's foot. In addition, the uppers in moccasins are oftentimes fitted with a fastening means such as, for example, a hook and loop fastening means (such as VELCRO™), laces, a buckle, or a zip, that can be used to secure the moccasin to the wearer's foot in use. When the fastening means is in an unfastened position, the opening in the upper can be widened to enable the wearer to remove their foot from the moccasin. However, even when the fastening means is unfastened, the opening can still be too small, thereby making it difficult for certain groups of persons such as infants, disabled or elderly persons to put on or remove such footwear. This is particularly noticeable for enclosed-style footwear having uppers made from materials with limited flexibility.

It is to be understood that, if any prior art information is referred to herein, such reference does not constitute an admission that the information forms part of the common general knowledge in the art, in Australia or any other country.

SUMMARY OF THE INVENTION

An object of the claimed invention is to provide a footwear which will overcome or substantially ameliorate at least some of the deficiencies of the prior art, or to at least provide an alternative.

According to a first aspect of the present invention, there is provided a footwear, comprising:

- a sole;
- an upper secured to the sole, the upper defining at least a front portion;
- an apron portion having first and second lateral portions and a lower end, each of the first and second lateral portions comprising a free lateral outer edge, the apron portion being attached at the lower end to the front portion; and
- a first fastening means for releasably connecting the first and second lateral portions together, the first fastening means being configurable between a fastened position in which the first and second lateral portions are held adjacent one another, and an unfastened position in which at least an upper portion of each of the first and second lateral portions, respectively, can be readily separated.

Advantageously, the first and second lateral portions of the apron portion being separable enable the opening of the footwear to be widened to allow a wearer to easily put on or remove the footwear.

Advantageously, the first fastening means in the unfastened position enables at least the upper portions of the first and second lateral portions to be separated thereby allowing the opening of the footwear to be widened to allow a wearer to easily put in or remove the footwear.

Advantageously, the first fastening means in the fastened position enables the first and second lateral portions to be joined together thereby narrowing the opening of the footwear.

Preferably, the apron portion has an upper end, and the first fastening means extends from the upper end to the lower end.

Advantageously, the first fastening means extends the length of the apron portion, such that when the first fastening means is in the unfastened position, the first and second lateral portions can be separated enabling the opening to be widened all the way to the front portion of the footwear.

Preferably, the first fastening means is a zip fastening means, the zip fastening means having first and second tapes, each tape being attached to opposing lateral inner edges of the first and second lateral portions, respectively, and each tape comprising a plurality of coupling elements located along the tape, and a pull tab being adapted to meshingly engage the plurality of coupling elements when the zip fastening means is in the fastened position and to disengage the plurality of coupling elements when the zip fastening means is in the unfastened position.

Advantageously, the zip fastening means enables the first and second lateral portions of the apron portion to be releasably connected quickly and easily.

Advantageously, the zip fastening means enables the first and second lateral portions to be releasably connected using one hand.

Preferably, the first fastening means includes any one of the following complementary fastening means: a hook and loop fastening means, a press stud fastening means, a buckle fastening means, a button and loop fastening means, and a lace fastening means.

Advantageously, the hook and loop fastening means enables the first and second lateral portions of the apron portion to be releasably connected quickly and easily.

Advantageously, the hook and loop fastening means enables the first and second lateral portions to be releasably connected using one hand.

Advantageously, the press stud fastening means enables the first and second lateral portions of the apron portion to be releasably connected quickly and easily.

Advantageously, the press stud fastening means enables the first and second lateral portions to be releasably connected using one hand.

Preferably, the upper further defines first and second lateral sides and one of the first and second lateral sides comprises a flap portion being configurable between an open position in which the flap portion is disengaged from the other of the first and second lateral sides and a closed position in which the flap portion is releasably engaged with the other of the first and second lateral sides.

Advantageously, the flap portion in the closed position provides a means to secure the footwear to the foot of the wearer in use.

Preferably, the footwear further comprises a second fastening means having a first complementary part mounted to the flap portion and a second complementary part mounted to the other of the first and second lateral sides.

Advantageously, the second fastening means enables the flap portion to be transitioned between the open and closed positions quickly and easily.

Preferably, the second fastening means includes any one of the following complementary fastening means: a hook and loop fastening means, a press stud fastening means, a buckle fastening means, and a button and loop fastening means.

Preferably, the footwear further comprises a tongue portion attached to the upper portion of one of the first and second lateral portions.

Advantageously, the tongue portion protects the top of the wearer's foot from the first fastening means when the footwear is worn in use.

Preferably, the sole is manufactured from one or more of the following materials, including, leather, a plastic, a textile, rubber, a synthetic, and wood.

Preferably, the upper is manufactured from a flexible material.

Advantageously, the upper is flexible to enable the opening of the footwear to be widened when the first fastening means is in the unfastened position.

Preferably, the apron portion is manufactured from a flexible material.

Advantageously, the apron portion is flexible to enable the opening of the footwear to be widened when the first fastening means is in the unfastened position.

Preferably, the flexible material includes one or more of the following materials, leather, a plastic, a textile, rubber, and a synthetic.

Preferably, the footwear further comprises an insole adapted to locate within the upper.

According to a second aspect of the present invention, there is provided a footwear, comprising:

a sole;

an upper secured to the sole, the upper defining at least a front portion, and first and second lateral sides;

an apron portion having first and second lateral portions, first and second lower side portions extending from the first and second lateral portions, respectively, and a lower end, each of the first and second lateral portions comprising a free lateral outer edge, the apron portion being attached at the lower end to the front portion, and attached at the first and second lower side portions to the first and second lateral sides, respectively; and a first fastening means for releasably connecting the first and second lateral portions together, the first fastening means being configurable between a fastened position in which the first and second lateral portions are held adjacent one another, and an unfastened position in which at least an upper portion of each of the first and second lateral portions, respectively, can be readily separated.

Advantageously, the first and second lateral portions of the apron portion being separable enable the opening of the footwear to be widened to allow a wearer to easily put on or remove the footwear.

Advantageously, the first fastening means in the unfastened position enables at least the upper portions of the first and second lateral portions to be separated thereby allowing the opening of the footwear to be widened to allow a wearer to easily put in or remove the footwear.

Advantageously, the first fastening means in the fastened position enables the first and second lateral portions to be joined together thereby narrowing the opening of the footwear.

Preferably, the apron portion has an upper end, and the first fastening means extends from the upper end to the lower end.

Advantageously, the first fastening means extends the length of the apron portion, such that when the first fastening means is in the unfastened position, the first and second lateral portions can be separated enabling the opening to be widened all the way to the front portion of the footwear.

Preferably, the first fastening means is a zip fastening means, the zip fastening means having first and second tapes, each tape being attached to opposing lateral inner edges of the first and second lateral portions, respectively, and each tape comprising a plurality of coupling elements located along the tape, and a pull tab being adapted to meshingly engage the plurality of coupling elements when the zip fastening means is in the fastened position and to disengage the plurality of coupling elements when the zip fastening means is in the unfastened position.

Advantageously, the zip fastening means enables the first and second lateral portions of the apron portion to be releasably connected quickly and easily.

Advantageously, the zip fastening means enables, the first and second lateral portions to be releasably connected using one hand.

Preferably, the first fastening means includes any one of the following complementary fastening means: a hook and loop fastening means, a press stud fastening means, a buckle fastening means, a button and loop fastening means, and a lace fastening means.

Advantageously, the hook and loop fastening means enables the first and second lateral portions of the apron portion to be releasably connected quickly and easily.

Advantageously, the hook and loop fastening means enables the first and second lateral portions to be releasably connected using one hand.

Advantageously, the press stud fastening means enables the first and second lateral portions of the apron portion to be releasbly connected quickly and easily.

Advantageously, the press stud fastening means enables the first and second lateral portions to be releasably connected using one hand.

Preferably, one of the first and second lateral sides comprises a flap portion being configurable between an open position in which the flap portion is disengaged from the other of the first and second lateral sides and a closed position in which the flap portion is releasably engaged with the other of the first and second lateral sides.

Advantageously, the flap portion in the closed position provides a means to secure the footwear to the foot of the wearer in use.

Preferably, the footwear further comprises a second fastening means having a first complementary part mounted to the flap portion and a second complementary part mounted to the other of the first and second lateral sides.

Advantageously, the second fastening means enables the flap portion to be transitioned between the open and dosed positions quickly and easily.

Preferably, the second fastening means includes any one of the following complementary fastening means: a hook and loop fastening means, a press stud fastening means, a buckle fastening means, and a button and loop fastening means.

Preferably, the footwear further comprises a tongue portion attached to the upper portion of one of the first and second lateral portions.

Advantageously, the tongue portion protects the top of the wearers foot from the first fastening means when the footwear is worn in use.

Preferably, the sole is manufactured from one or more of the following materials, including, leather, a plastic, a textile, rubber, a synthetic, and wood.

Preferably, the upper is manufactured from a flexible material.

Advantageously, the upper is flexible to enable the opening of the footwear to be widened when the first fastening means is in the unfastened position.

Preferably, the apron portion is manufactured from a flexible material.

Advantageously, the apron portion is flexible to enable the opening of the footwear to be widened when the first fastening means is in the unfastened position.

Preferably, the flexible material includes one or more of the following materials, leather, a plastic, a textile, rubber, and a synthetic.

Preferably, the footwear further comprises an insole adapted to locate within the upper.

According to a third aspect of the present invention, there is provided a footwear, comprising:

a blank defining at least a sole portion and an upper having a front portion;

an apron portion having first and second lateral portions and a lower end, each of the first and second lateral portions comprising a free lateral outer edge, the apron portion being attached at the lower end to the front portion; and a first fastening means for releasably connecting the first and second lateral portions together, the first fastening means being configurable between a fastened position in which the first and second lateral portions are held adjacent one another, and an unfastened position in which at least an upper portion of each of the first and second lateral portions, respectively, can be readily separated.

Advantageously, the blank defining the sole portion ensures that no additional outer sole, in particular, a rigid outer sole, is required, thereby making the footwear suitable for use as a pre-walker.

Advantageously, the blank defining the sole portion ensures that the sole portion is void of a raised heel, thereby making the footwear suitable for use as a pre-walker.

Advantageously, the first and second lateral portions of the apron portion being separable enable the opening of the footwear to be widened to allow a wearer to easily put on or remove the footwear.

Advantageously, the first fastening means in the unfastened position enables at least the upper portions of the first and second lateral portions to be separated thereby allowing the opening of the footwear to be widened to allow a wearer to easily put in or remove the footwear.

Advantageously, the first fastening means in the fastened position enables the first and second lateral portions to be joined together thereby narrowing the opening of the footwear.

Preferably, the apron portion has an upper end, and the first fastening means extends from the upper end to the lower end.

Advantageously, the first fastening means extends the length of the apron portion, such that when the first fastening means is in the unfastened position, the first and second lateral portions can be separated enabling the opening to be widened all the way to the front portion of the footwear.

Preferably, the first fastening means is a zip fastening means, the zip fastening means having first and second tapes, each tape being attached to opposing lateral inner edges of the first and second lateral portions, respectively, and each tape comprising a plurality of coupling elements located along the tape, and a pull tab being adapted to meshingly engage the plurality of coupling elements when the zip fastening means is in the fastened position and to disengage the plurality of coupling elements when the zip fastening means is in the unfastened position.

Advantageously, the zip fastening means enables the first and second lateral portions of the apron portion to be releasably connected quickly and easily.

Advantageously, the zip fastening means enables the first and second lateral portions to be releasably connected using one hand.

Preferably, the first fastening means includes any one of the following complementary fastening means: a hook and loop fastening means, a press stud fastening means, a buckle fastening means, a button and loop fastening means, and a lace fastening means.

Advantageously, the hook and loop fastening means enables the first and second lateral portions of the apron portion to be releasably connected quickly and easily.

Advantageously, the hook and loop fastening means enables the first and second lateral portions to be releasably connected using one hand.

Advantageously, the press stud fastening means enables the first and second lateral portions of the apron portion to be releasably connected quickly and easily.

Advantageously, the press stud fastening means enables the first and second lateral portions to be releasably connected using one hand.

Preferably, the blank further defines first and second lateral sides and one of the first and second lateral sides comprises a flap portion being configurable between an open position in which the flap portion is disengaged from the other of the first and second lateral sides and a closed position in which the flap portion is releasably engaged with the other of the first and second lateral sides.

Advantageously, the flap portion in the closed position provides a means to secure the footwear to the foot of the wearer in use.

Preferably, the footwear further comprises a second fastening means having a first complementary part mounted to the flap portion and a second complementary part mounted to the other of the first and second lateral sides.

Advantageously, the second fastening means enables the flap portion to be transitioned between the open and closed positions quickly and easily.

Preferably, the second fastening means includes any one of the following complementary fastening means: a hook and loop fastening means, a press stud fastening means, a buckle fastening means, and a button and loop fastening means.

Preferably, the footwear further comprises a tongue portion attached to the upper portion of one of the first and second lateral portions.

Advantageously, the tongue portion protects the top of the wearer's foot from the first fastening means when the footwear is worn in use.

Preferably, the sole portion comprises a ground-engaging surface adapted for imparting an anti-slip character to at least a portion of the sole portion.

Advantageously, the anti-slip character provides the wearer with enhanced grip for walking on slippery surfaces.

Preferably, the ground-engaging surface comprises a tread means.

Advantageously, the tread means provides the anti-slip character to afford wearers with enhanced grip for walking on slippery surfaces.

Preferably, the tread means comprises at least one protrusion.

Preferably, the at least one protrusion comprises a plurality of protrusions disposed on the portion of the sole portion in spaced-apart arrangement.

Preferably, the at least one protrusion is manufactured from an elastomeric material.

Advantageously, the at least one protrusion being of an elastomeric material, affords the wearer with enhanced grip for walking on slippery surfaces.

Preferably, the elastomeric material is selected from the group of elastomeric materials comprising: natural rubber; synthetic rubber; thermoset and thermoplastic elastomeric materials.

Preferably, the blank is manufactured from a flexible material.

Advantageously, the blank being flexible enables the opening of the footwear to be widened when the first fastening means is in the unfastened position.

Advantageously, the blank being flexible allows for a flexible sole portion to provide added comfort to the wearer.

Preferably, the apron portion is manufactured from a flexible material.

Advantageously, the apron portion is flexible to enable the opening of the footwear to be widened when the first fastening means is in the unfastened position.

Preferably, the flexible material includes one or more of the following materials, leather, a plastic, a textile, rubber, and a synthetic Material.

Preferably, the footwear further comprises an insole adapted to locate between the sole portion and the upper.

Other aspects of the invention are also disclosed.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

DETAILED DESCRIPTION OF SPECIFIC EMBODIMENTS

Figure 1:
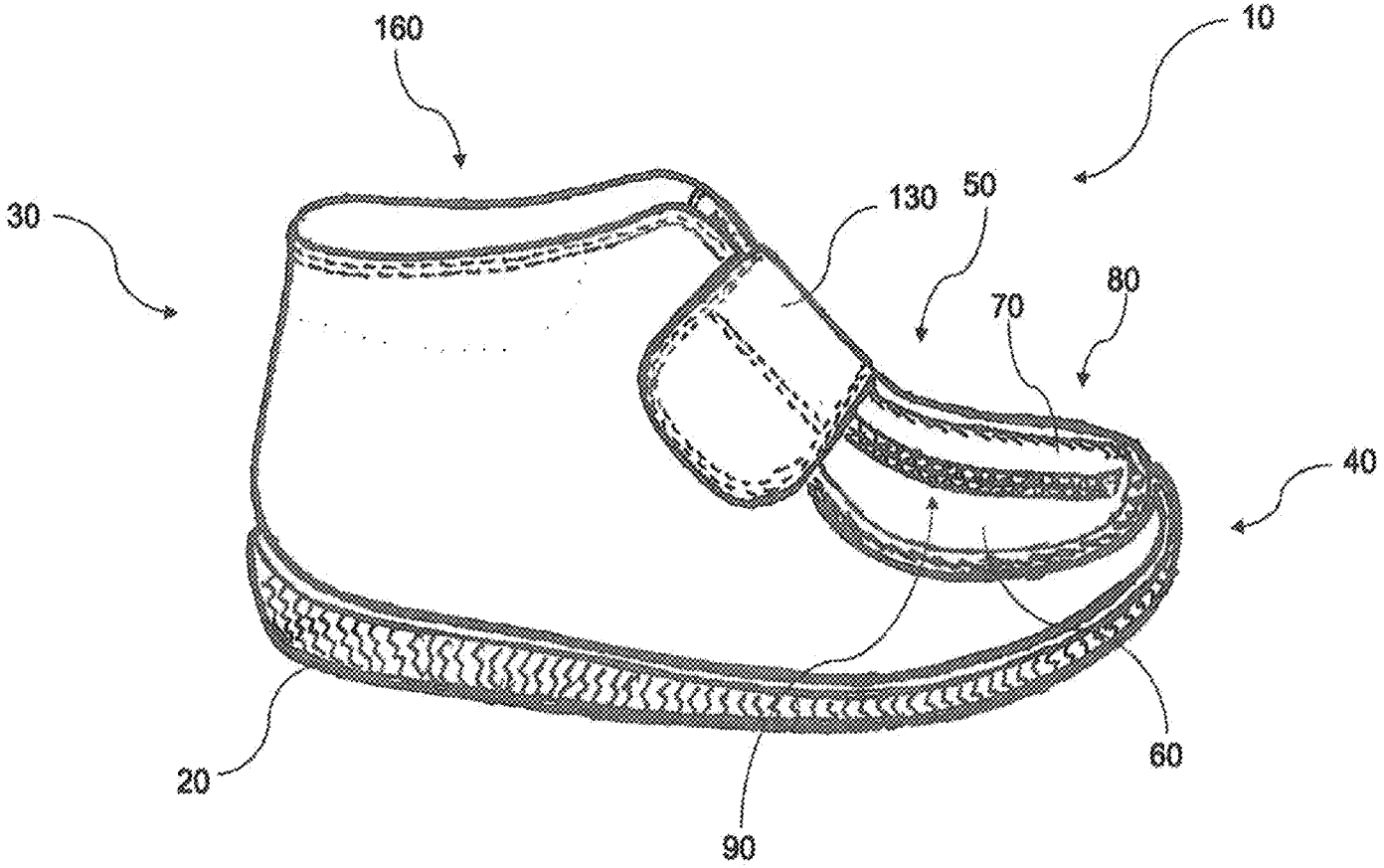
FIG. 1 is a side view of a moccasin having a first fastening means in accordance with a preferred embodiment of the present invention, the first fastening means being in a fastened position.

It should be noted in the following description that like or the same reference numerals in different embodiments denote the same or similar features.

Throughout this specification, the term footwear should be construed to encompass any type of footwear which is of an enclosed-style, as opposed to sandal-style. That is, it should be considered to encompass boots, sports shoes, pre-walkers, and any like type of footwear which is used for walking or running, or the like, and which provides an outer covering for a wearer's foot that is shaped to fit the foot. Likewise, when the term enclosed-style footwear is used, this should be considered to encompass footwear which may not totally enclose the toes and heels of the wearer, but rather, could be partly open, have holes, slits or like patterns cut out of the footwear, but would not be classified as sandal-style footwear.

According to a first embodiment of the present invention, and as shown in FIGS. 1 to 4, there is provided an enclosed-style footwear in the form of a moccasin 10, comprising: a sole 20 and an upper 30 secured to the sole 20. The upper 30 is secured to the sole 20 using any suitable means of attachment, including, but not limited to, one of the following attachment means: stitching, be it machine or hand stitching, an adhesive such as a polychloroprene or polyurethane adhesive, nails, or a combination thereof. The sole 20 may be manufactured from any one or more of the following materials, including, but not limited to, leather, a plastic such as polyurethane or polyvinyl chloride, textile, rubber, synthetic, wood, or a combination thereof. In this embodiment, the sole 20 is manufactured from rubber. Once secured to the sole 20, the upper 30 defines at least an opening, herein given reference numeral 160, which is located towards the rear of the moccasin 10 for receiving a wearer's foot therein. The upper 30 also defines a front portion 40 located towards the front of the moccasin 10 to receive the front part of the wearer's foot including the toes, and a back portion (or counter) located at the rear of the moccasin 10 to receive the wearer's heel therein. The moccasin 10 also comprises an apron portion 50 having a lower end 80 and an upper end 100. The apron portion 50 is divided into first 60 and second 70 lateral portions that extend substantially along the length of the apron portion 50 from the upper end 100 to the lower end 80, with each of the first 60 and second 70 lateral portions comprising a lateral outer edge 65, 75, respectively. The upper 30 and apron portion 50 may be manufactured from any suitable material, preferably a flexible material, including, but not limited to, one of the following flexible materials: leather, such as leather or suede from a goat, sheep or calf, a plastic such as polyurethane or polyvinyl chloride, a textile such as cotton or canvas, a rubber such as resin rubber, vulcanized rubber or cellulized rubber, synthetic, or a combination thereof. It will be appreciated that as the upper 30 and apron portion 50 are manufactured from flexible materials, this ensures that when the first fastening means 90 is in the unfastened position, their flexibility enables the opening 160 of the moccasin 10 to be widened. In this embodiment, the upper 30 and apron portion 50 are each manufactured from leather.

Figure 2:
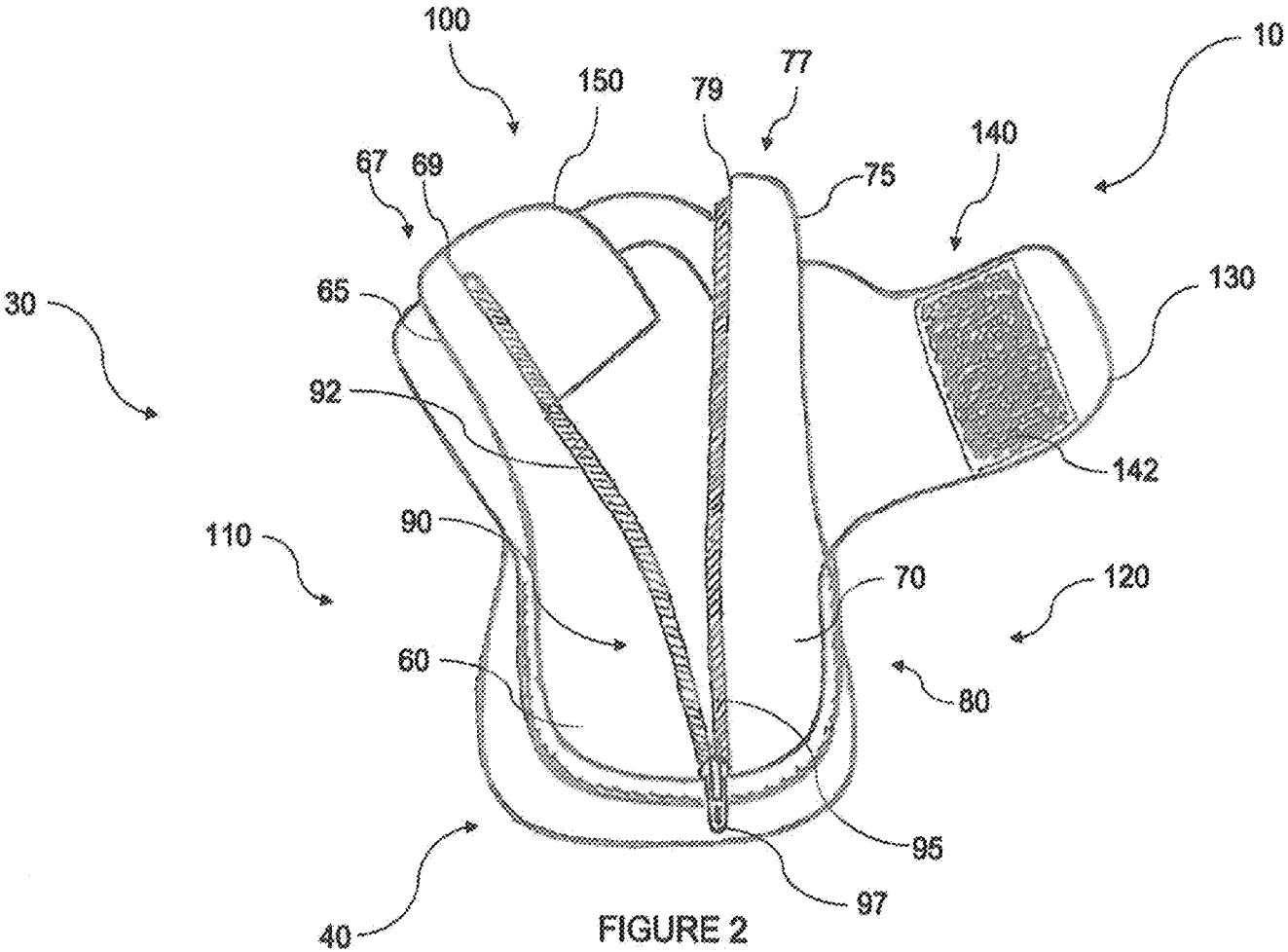
FIG. 2 is a front view of the moccasin of FIG. 1, wherein the first fastening means is in an unfastened position.

As shown in, for example, FIG. 2, the lower end 80 of the apron portion 50 is attached to the front portion 40 of the upper 30 using any suitable means of attachment, including, but not limited to: stitching, gluing, or a combination thereof. It will be appreciated that the stitching of the lower end 80 of the apron portion 50 to the front portion 40 of the upper 30 may be achieved by hand stitching, machine stitching, or a combination thereof. In this embodiment, the lower end 80 of the apron portion 50 is attached to the front portion 40 of the upper 30 by stitching with a thread manufactured from a suitable material, including, but not limited to, cotton, linen, nylon, polyester or leather. In this embodiment, the lower end 80 of the apron portion 50 is stitched by hand to the front portion 40 of the upper 30 from point 200A on the lateral outer edge 65 of the first 60 lateral portion, around the periphery of the lower end 80 of the apron portion 50 to point 200B on the lateral outer edge 75 of the second 70 lateral portion, where the stitching of the apron portion 50 to the front portion 40 of the upper 30 first starts. As such, the upper end 100 of the apron portion 50, and thus the lateral outer edges 65, 75 associated with the upper end 100, are able to move freely by virtue of the apron portion 50 being manufactured of a flexible material, while the lower end 80 of the apron portion 50 remains attached to the front portion 40.

Referring to FIGS. 1 to 4, the moccasin 10 further comprises a first fastening means 90 for releasably connecting the first 60 and second 70 lateral portions of the apron portion 50 together. The first fastening means 90 is configurable between a fastened position (see FIGS. 1 and 4) in which the first 60 and second 70 lateral portions are held adjacent one another, and an unfastened position (see FIGS. 2 and 3) in which at least an upper portion 67, 77 of each of the first 60 and second 70 lateral portions, respectively, can be readily separated.

In this embodiment, the first fastening means 90 is a zip fastening means 90 having first 92 and second 95 tapes, each tape comprising a plurality of coupling elements located along the tape, and each tape being attached to opposing lateral inner edges 69, 79 of the first 60 and second 70 lateral portions, respectively, using any suitable means of attachment, including, but not limited to, any one of the following: stitching, gluing, or a combination thereof. The zip fastening means 90 further comprises a pull tab 97 being adapted to meshingly engage the plurality of coupling elements of the first 92 and second 95 tapes when the zip fastening means 90 is in the fastened position and to disengage the plurality of coupling elements when the zip fastening means 90 is in the unfastened position.

It will be appreciated that in other embodiments, the first fastening means 90 may be any one of a number of fastening means including, but not limited to, one of the following: a hook and loop fastening means (such as VELCRO™), a press stud fastening means, a buckle fastening means, a button and loop fastening means, or a lace fastening means.

Figure 3:
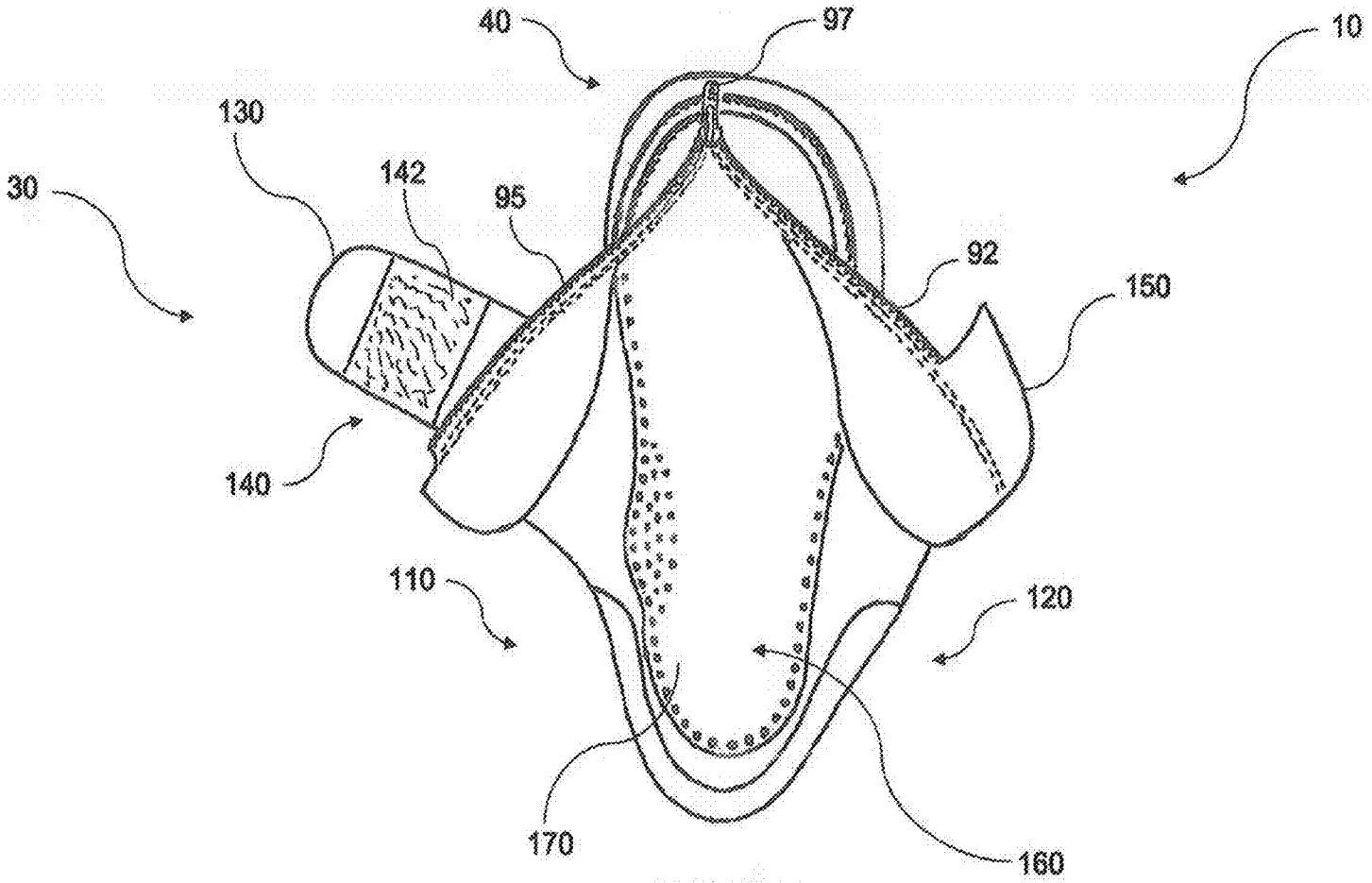
FIG. 3 is a top view of the moccasin of FIG. 2.
Figure 4:
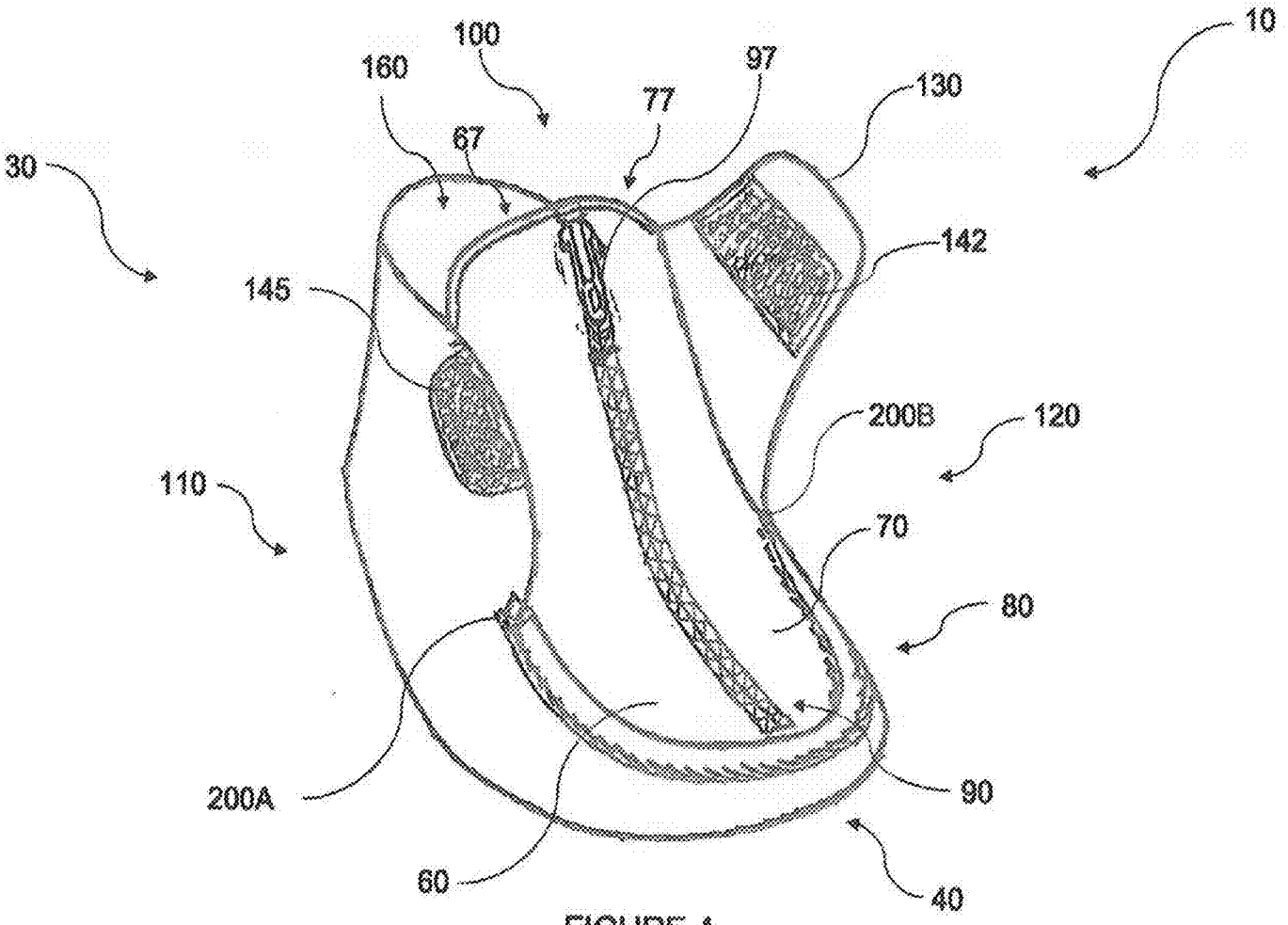
FIG. 4 is a perspective view of the moccasin of FIG. 1.

As shown in FIGS. 2 to 4, the zip fastening means 90 extends from the upper end 100 of the apron portion 50 to the lower end 80, such that in use, when the zip fastening means 90 is in the unfastened position (see FIGS. 2 and 3), at least the upper portions 67, 77 of the first 60 and second 70 lateral portions can be separated thereby allowing the opening 160 of the moccasin 10 to be widened all the way to the line of stitching at the front portion 40 of the moccasin 10 to enable a wearer to easily put in or remove their foot from the moccasin 10. This is beneficial in situations where the wearer may have difficulty putting on or taking off the moccasin 10, such as in situations where the wearer is a child, a disabled or elderly person, or a person suffering from a foot injury. However, it will be appreciated that the moccasin 10 may also be conveniently used by any person, whether they have this physical limitation or not.

As shown in FIG. 4, when the zip fastening means 90 is in the fastened position (see FIGS. 1 and 4) and at least the upper portions 67, 77 of the first 60 and second 70 lateral portions are held adjacent one another, the opening 160 of the moccasin 10 is still of a size that will enable a person without the aforementioned physical limitations to be able to put on or remove the moccasin 10 from their foot by virtue of the apron portion 50 being of a flexible material such: that the upper end 100 is capable of flexing. The zip fastening means 90 in the fastened position will also assist in preventing the moccasin 10 from falling off the wearer's foot as the lower end 80 of the apron portion 50 being stitched to the front portion 40 of the upper 30 encapsulates the front part of the wearer's foot including the toes within the front portion 40.

As shown in FIGS. 2 to 4, the upper 30 further defines first 110 and second 120 lateral sides with one of the first 110 and second 120 lateral sides comprising a flap portion 130 being configurable between an open position in which the flap portion 130 is disengaged from the other of the first 110 and second 120 lateral sides and a closed position in which the flap portion 130 is releasably engaged with the other of the first 110 and second 120 lateral sides. The flap portion 130 is releasably engaged with the other of the first 10 and second 120 lateral sides of the upper 30 by virtue of a second fastening means 140 having a first complementary part 142 mounted to the flap portion 130 and a second complementary part 145 mounted to the other of the first 110 and second 120 lateral sides. The second fastening means 140 may include any one of the following complementary fastening means: a hook and loop fastening means (such as VELCRO™), a press stud fastening means, a buckle fastening means, a button and loop fastening means. In this embodiment, and as shown in FIGS. 2 to 3, the second fastening means 140 is a hook and loop fastening means 140 (such as VELCRO™) thereby enabling the flap portion 130 to be transitioned by the wearer between the open and closed positions quickly and easily using one hand. As shown in FIG. 1, when the flap portion 130 is in the closed position, the flap portion 130 overlays the apron portion 50 to releasably engage the other of the first 110 and second 120 lateral sides of the upper 30 to secure the moccasin 10 to the foot of the wearer in use.

As shown in FIGS. 2 and 3, the moccasin 10 further comprises a tongue portion 150 attached to the upper portion 67, 77 of one of the first 60 and second 70 lateral portions of the apron portion 50. The tongue portion 150 is preferably attached to an inner surface of the upper portion 67, 77 such that it engages the wearer's foot in use, thereby protecting the top of the wearer's foot from the zip fastening means 90. The tongue portion 150 may be attached to inner surface of the upper portion 67, 77 using any suitable means of attachment, including, but not limited to, gluing, stitching, or a combination thereof. The tongue portion 150 may be manufactured from any suitable material, preferably a suitable flexible material, including, but not limited to, any one of the following flexible materials: leather, suede, plastic, textile, rubber, synthetic, or a combination thereof.

The moccasin 10 also comprises an insole 170 (see FIG. 3) adapted to locate within the upper 30. In this embodiment, the insole 170 is a full insole 170 that extends the full-length of the inside of the moccasin 10 from the front portion 40 to the back portion or counter. The insole 170 is preferably attached within the upper 30 using a suitable adhesive. The insole 170 may be manufactured from any suitable material, preferably a suitable flexible material, including, but not limited to, any one of the following flexible materials: leather, suede, plastic, textile, rubber, synthetic, or a combination thereof.

It will be appreciated that other elements commonly associated with everyday moccasins such as arch or ankle supports may also be incorporated into the moccasin 10. For example, the moccasin 10 may comprise a heel counter or stiffener (not shown) located at the back portion of the moccasin 10 to form and shape the back portion to support the wearer's ankle in use. The heel counter may be attached to the back portion of the moccasin 10 using any suitable means of attachment, including, but not limited to, an adhesive, stitching, or a combination thereof. The moccasin 10 may also comprise a shank (not shown) to provide rigidity to the moccasin 10. The shank extends inside of the moccasin 10 from the back portion (counter) to a point corresponding to the position where the ball of the wearer's foot would be in use. It will be appreciated that the shank would lie beneath the insole 170. The shank may be attached to the back portion of the moccasin 10 using any suitable means of attachment, including, but not limited to, nails, an adhesive, stitching, or a combination thereof. The shank may be manufactured from any suitable material, preferably a suitable rigid material, including, but not limited to, one of the following rigid materials: leatherboard, a plastic, a synthetic, or a combination thereof.

It will be appreciated that the construction of the moccasin 10 involves a highly specialized manufacturing process to ensure that the moccasin 10 has the necessary softness and flexibility, while still providing the necessary support at the ankle and heel areas of the moccasin 10.

The moccasin 10 provides a number of advantages, including:

1. The first 60 and second 70 lateral portions of the apron portion 50 being separable enable the opening 160 of the moccasin 10 to be widened to allow a wearer to easily put on or remove the moccasin 10.
2. The first fastening means 90 in the unfastened position enables at least the upper portions 67, 77 of the first 60 and second 70 lateral portions to be separated thereby allowing the opening 160 of the moccasin 10 to be widened to allow a wearer to easily put on or remove the moccasin 10.
3. The first fastening means 90 in the fastened position enables the first 60 and second 70 lateral portions to be joined together thereby narrowing the opening 160 of the moccasin 10.
4. The first fastening means 90 extends the length of the apron portion 50, such that when the first fastening means 90 is in the unfastened position, the first 60 and second 70 lateral portions can be separated enabling the opening 160 to be widened all the way to the front portion 40 of the moccasin 10.
5. The zip fastening means 90 enables the first 60 and second 70 lateral portions of the apron portion 50 to be releasably connected quickly and easily.
6. The zip fastening means 90 enables the first 60 and second 70 lateral portions to be releasably connected using one hand.
7. The flap portion 130 in the closed position provides a means to secure the moccasin 10 to the foot of the wearer in use.
8. The second fastening means 140 enables the flap portion 130 to be transitioned between the open and closed positions quickly and easily.
9. The tongue portion 150 protects the top of the wearer's foot from the first fastening means 90 when the moccasin 10 is worn in use.
10. The upper 30 is flexible to enable the opening 160 of the moccasin 10 to be widened when the first fastening means 90 is in the unfastened position.
11. The apron portion 50 is flexible to enable the opening 160 of the moccasin 10 to be widened when the first fastening means 90 is in the unfastened position.

Figure 5:
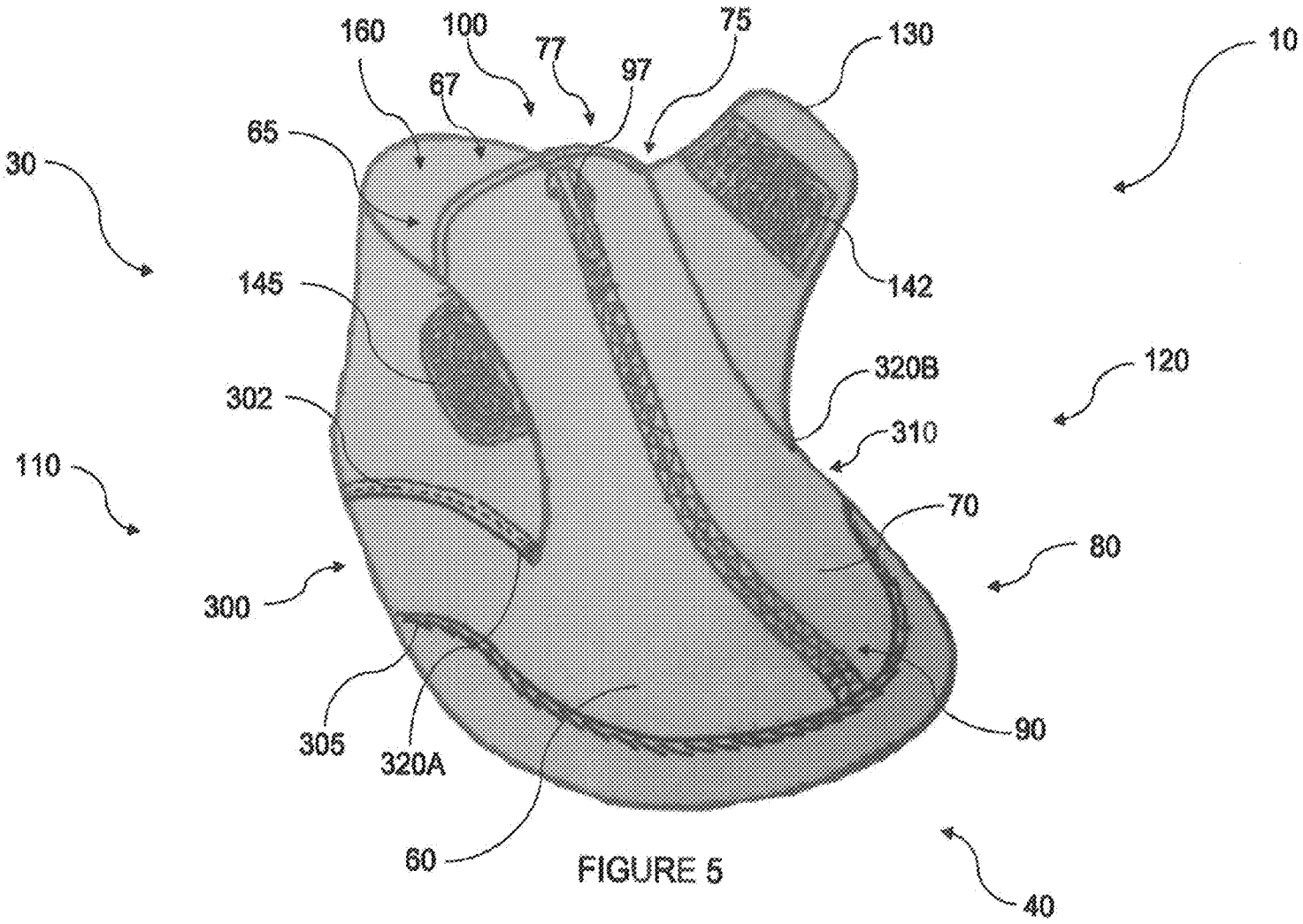
FIG. 5 is a perspective view of a moccasin in accordance with another preferred embodiment of the present invention.

According to a second embodiment of the present invention, the apron portion 50 of the moccasin 10 described in the first embodiment of the present invention further comprises first 300 and second 310 lower side portions extending from the first 60 and second 70 lateral portions, respectively. As shown in FIG. 5, the first 300 and second 310 lower side portions extend from the first 60 and second 70 lateral portions, respectively, in a direction substantially away from the first 60 and second 70 lateral portions, respectively, such that the first 300 and second 310 lower side portions are in positions to partially overlap the first 110 and second 120 lateral sides of the upper 30, respectively. The first 300 and second 310 lower side portions being integral with the first 60 and second 70 lateral portions, are thus manufactured from the same flexible material, including, but not limited to, one of the following flexible materials: leather, such as leather or suede from a goat, sheep or calf, a plastic such as polyurethane or polyvinyl chloride, a textile such as cotton or canvas, a rubber such as resin rubber, vulcanized rubber or cellulized rubber, synthetic, or a combination thereof. In this embodiment, the upper 30 and the first 300 and second 310 lower side portions and first 60 and second 70 lateral portions of the apron portion 50, are each manufactured from leather.

As shown in FIG. 5, the apron portion 50 is attached at the lower end 80 to the front portion 40 of the upper 30 and is also attachd at the first 300 and second 310 lower side portions to the first 110 and second 120 lateral sides of the upper 30, respectively, using any suitable means of attachment, including, but not limited to: stitching, gluing, or a combination thereof. It will be appreciated that the stitching of the lower end 80 of the apron portion 50 to the front portion 40 of the upper 30 and the stitching of the first 300 and second 310 lower side portions to the first 110 and second 120 lateral sides of the upper 30, respectively, may be achieved by hand stitching, machine stitching, or a combination thereof. In this embodiment, the lower end 80 and the first 300 and second 310 lower side portions of the apron portion 50 are attached to the front portion 40 and first 110 and second 120 lateral sides of the upper 30, respectively, by hand or machine stitching with a thread manufactured from a suitable material, including, but not limited to, cotton, linen, nylon, polyester or leather. In this embodiment, the stitching of the lower end 80 of the apron portion 50 to the front portion 40 of the upper 30 and the stitching of the first 300 and second 310 lower side portions to the first 110 and second 120 lateral sides of the upper 30, respectively, is performed in three distinct acts. However, it will be appreciated that in other embodiments, the stitching may occur in a single act.

As shown in FIG. 5, the first 300 lower side portion is stitched to the first 110 lateral side of the upper 30 from a point 320A on the lateral outer edge 65 of the first 60 lateral portion, down a first edge 302 of the first 300 lower side portion in the direction of the sole 20. In this embodiment, a terminal end (not shown) of the first 300 lower side portion is tucked in between the upper 30 and the sole 20 and stitched to an underside of the insole 170. The stitching then continues up a second edge 305 of the first 300 lower side portion to the lower end 80 of the apron portion 50. Stitching between the lower end 80 and the front portion 40 then continues around the periphery of the lower end 80 of the apron portion 50 to the second 310 lower side portion, whereafter the second 310 lower side portion is stitched down a first edge (not shown) of the second 310 lower side portion in the direction of the sole 20. Similarly, a terminal end (not shown) of the second 310 lower side portion is tucked in between the upper 30 and the sole 20 and stitched to an underside of the insole 170. Stitching then continues up a second edge (not shown) of the second 310 lower side portion to a point 320B on the lateral outer edge 75 of the second 70 lateral portion. As such, the upper end 100 of the apron portion 50, and thus the lateral outer edges 65, 75 associated with the upper end 100, are able to move freely by virtue of the apron portion 50 being manufactured of a flexible material, while the first 300 and second 310 lower side portions and the lower end 80 of the apron portion 50 remain attached to the first 110 and second 120 lateral sides and the front portion 40, respectively.

It will be appreciated that when the first 300 and second 310 lower side portions are attached to the first 110 and second 120 lateral sides of the upper 30, respectively, the first 60 and second 70 lateral portions of the apron portion 50 can still be fastened and unfastened as described in the first embodiment of the present invention, namely, when the zip fastening means 90 is in the fastened position, the first 60 and second 70 lateral portions of the apron portion 50 are held adjacent one another, and when the zip fastening means 90 is in the unfastened position, at least an upper portion 67, 77 of each of the first, 60 and second 70 lateral portions, respectively, can be readily separated.

Figure 6:
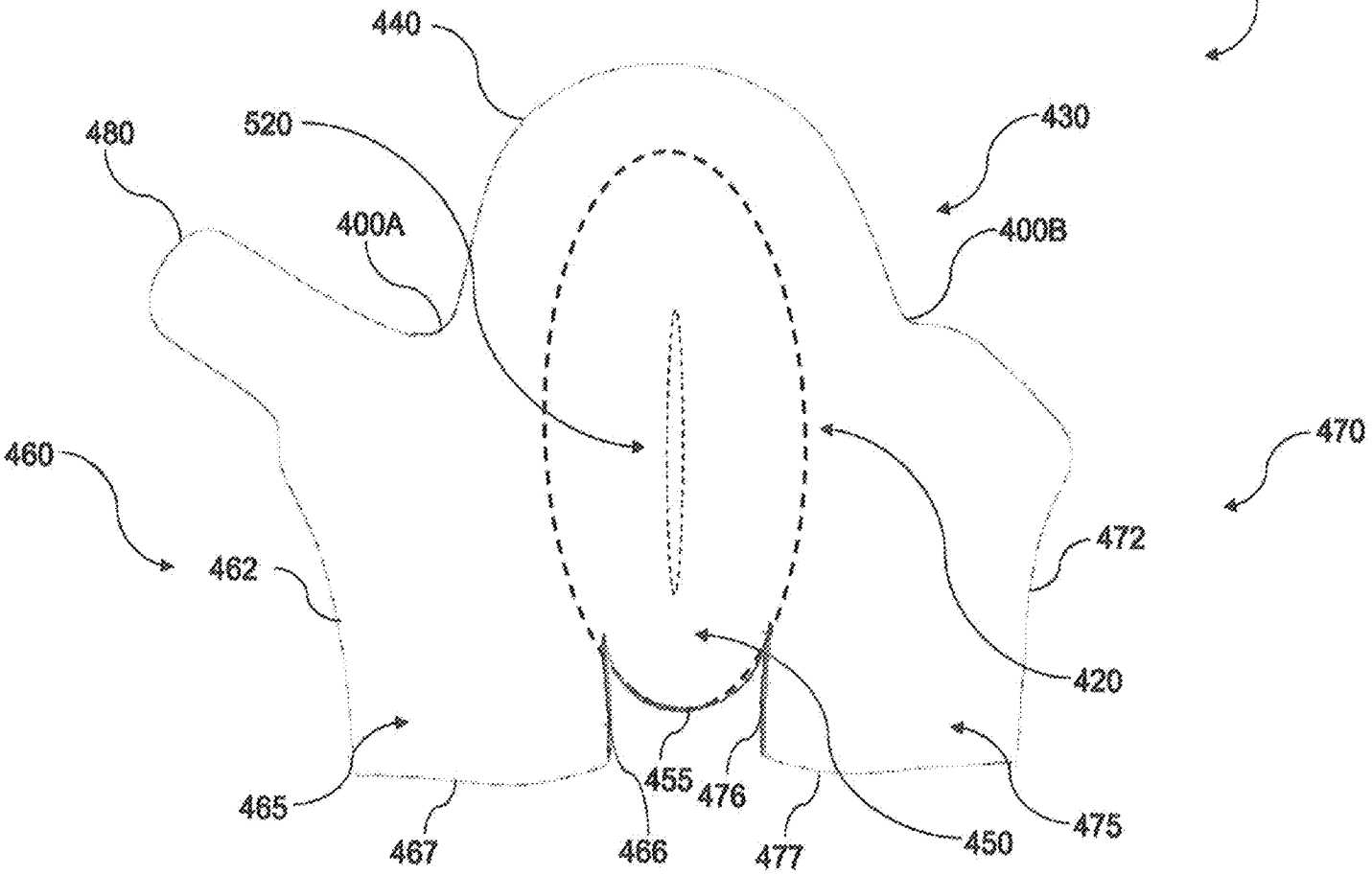
FIG. 6 is a plan view of a blank for a moccasin.

FIG. 6 shows a blank 410 for use in the manufacture of a moccasin 400 according to another preferred embodiment. The blank 410 is a unitary piece of suitable material that is shaped to define a sole portion 420, as shown in dashed outline) and an upper 430 of the moccasin 400. The blank 410 defines the front portion 440 of the upper 430 located towards the front of the moccasin 400 to receive the front part of the wearer's foot including the toes.

The blank 410 also defines first and second lateral sides 460 and 470 of the upper 430, in which the first lateral side 460 comprises a flap portion 480 for mounting a first part (not shown) of a fastening means to an inner surface thereof, and the second lateral side 470 is adapted for mounting a complementary part (not shown) of the fastening means to an external surface thereof. As described above, the fastening means may be any suitable means of fastening to enable releasable attachment of the first and second parts of the fastening means, thus allowing the flap portion 480 to be engaged and disengaged from the second lateral side 470 in use. In the preferred embodiment, the fastening means is a hook and loop fastening means (such as VELCRO™).

The first and second lateral sides 460 and 470 each comprise a back portion 465 and 475, respectively, located distal to the front portion 440. Both back portions 465 and 475 comprise a first lateral edge 466 and 476, and a second lateral edge 467 and 477, respectively, disposed generally perpendicularly to the corresponding first lateral edge 466 and 476.

The sole portion 420 comprises a rear portion 450 disposed distal to the front portion 440. The rear portion 450 comprises a lateral edge 455 disposed generally between the first lateral edges 466 and 476 of the back portions 465 and 475, respectively.

Figure 7:
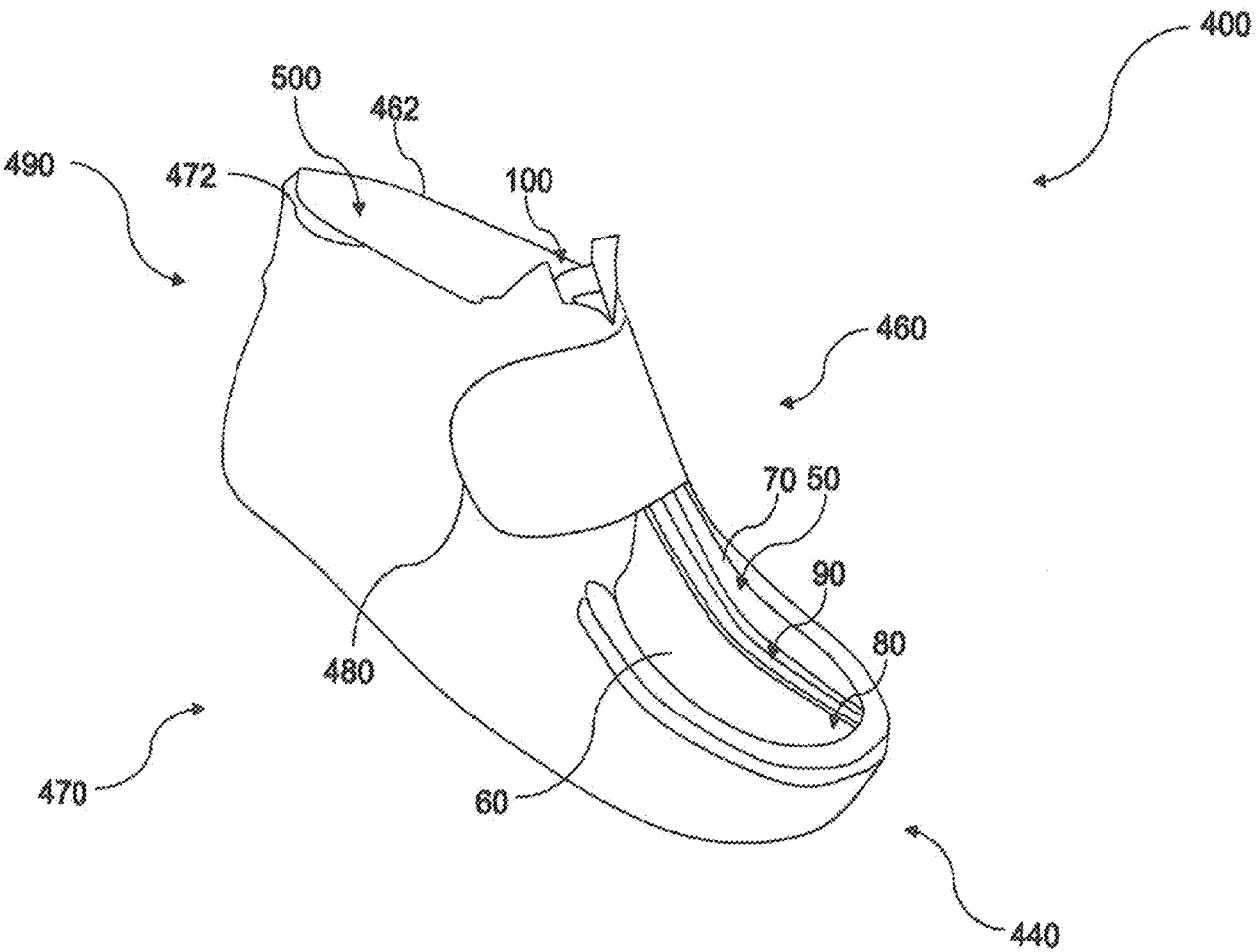
FIG. 7 is a perspective view of a moccasin formed from the blank of FIG. 6.

To form the moccasin 400, as shown in FIG. 7, the back portions 465 and 475 of the two lateral sides 460 and 470, respectively, are stitched to a corresponding portion of the lateral edge 455 of the rear portion 450 along their first lateral edges 466 and 476, respectively. The back portions 465 and 475 are then stitched together along their respective second lateral edges 467 and 477. The stitched first and second back portions 465 and 475, respectively, and the rear portion 450 of the sole portion 420 together define a back portion (or counter) 490 located at the rear of the moccasin 400 to receive the wearer's heel therein.

In this arrangement, the upper 430 is disposed generally upwardly relative to the sole portion 420 so that lateral edges 462 and 472 of the first and second lateral sides 460 and 470, respectively, define at least the opening of the moccasin 400, herein given reference numeral 500, which is located towards the rear of the moccasin 400 for receiving a wearer's foot therein.

In this embodiment, the external facing of the sole portion 410 defines the ground-engaging surface in use. Therefore, to assist grip for walking on slippery surfaces, the ground-engaging surface comprises a tread means (not shown) for imparting an anti-slip character to the sole portion 410. The tread means is in the form of a plurality of protrusions (not shown) disposed on ground-engaging surface of the sole portion 410 in spaced-apart arrangement. The protrusions are manufactured from an elastomeric material such as natural rubber; synthetic rubber; thermoset or thermoplastic elastomeric materials.

The apron portion 50 described in the embodiments above is attached to upper 430 in the same way, via its lower end 80 to the front portion 440 of the upper 430 by hand stitching from point 400A on the lateral outer edge (not shown) of the first 60 lateral portion, around the periphery of the lower end 80 of the apron portion 50 to point 400B on the lateral outer edge (not shown) of the second 70 lateral portion, where the stitching of the apron portion 50 to the front portion 440 of the upper 430 first starts. As such, the upper end 100 of the apron portion 50, and thus the lateral outer edges associated with the first 60 and second 70 lateral portions at the upper end 100, are able to move freely by virtue of the apron portion 50 being manufactured of a flexible material, while the lower end 80 of the apron portion 50 remains attached to the front portion 440.

As shown in FIG. 6, the blank 410 comprises a sector 520 (as shown in dashed outline) cut out from the sole portion 420 of the blank 410 along a generally longitudinal axis of the blank 410 from the front portion 440 to the back portion 490. In use, the edges of the sector 520 are sewn together as to narrow the sole portion 420. In this arrangement, the sole portion 420, and thus the moccasin 400 in general, can be shaped to accommodate a narrower foot.

In this embodiment, the blank 410 and apron portion 50 are both manufactured from a suitable flexible material such as leather.

It will be appreciated that the construction of the moccasin 400 involves a highly specialized manufacturing process to ensure that the moccasin 400 formed from the blank 410 and apron portion 50 has the necessary softness and flexibility, while still providing the necessary support at the ankle and heel areas of the moccasin 400. Such a moccasin 400 is thus highly suitable for use as a pre-walker for infants, whereby the softness, flexibility and support afforded by the moccasin 400 are ideal for growing feet. Such a pre-walker provides the infant with a suitable degree of support to instill confidence in the infant when walking, and provides the necessary degree of flexibility and comfort that is not found in shoes that are fitted with a rigid sole.

The moccasin 400 provides a number of advantages, including:

1. The sole portion 420 ensures that no additional outer sole, in particular, a rigid outer sole, is required, thereby making the moccasin 400 suitable for use as a pre-walker.
2. The sole portion 420 is flat and void of a raised heel, thereby making the moccasin 400 suitable for use as a pre-walker.
3. The first 60 and second 70 lateral portions of the apron portion 50 being separable enable the opening 500 of the moccasin 400 to be widened to allow the moccasin 400 to be easily put on or removed from the foot of an infant.
4. The first fastening means 90 in the unfastened position enables at least the upper portions 67, 77 of the first 60 and second 70 lateral portions to be separated thereby allowing the opening 500 of the moccasin 400 to be widened to allow the moccasin 400 to be easily put on or removed from the foot of an infant.
5. The first fastening means 90 in the fastened position enables the first 60 and second 70 lateral portions to be joined together thereby narrowing the opening 500 of the moccasin 400.
6. The first fastening means 90 extends the length of the apron portion 50, such that when the first fastening means 90 is in the unfastened position, the first 60 and second 70 lateral portions can be separated enabling the opening 500 to be widened all the way to the front portion 440 of the moccasin 400.
7. The zip fastening means 90 enables the first 60 and second 70 lateral portions of the apron portion 50 to be releasably connected quickly and easily.
8. The zip fastening means 90 enables the first 60 and second 70 lateral portions to be releasably connected using one hand.
9. The flap portion 480 in the closed position provides a means to secure the moccasin 400 to the foot of the infant in use.

10. The use of a hook and loop fastening means enables the flap portion 480 to be transitioned between the open and closed positions quickly and easily.
11. The blank 410 being flexible provides a comfortable yet supportive moccasin 400 for use a pre-walker for infants.
12. The blank 410 being flexible enables the opening 500 of the moccasin 400 to be widened when the first fastening means 90 is in the unfastened position.
13. The apron portion 50 being flexible enables the opening 500 of the moccasin 400 to be widened when the first fastening means 90 is in the unfastened position.

In other embodiments, the blank 410 is not limited to being manufactured from leather, but may be manufactured from any one or more of the following flexible materials: a plastic such as polyurethane or polyvinyl chloride, a textile such as cotton or canvas.

In other embodiments the tread means is not limited to being disposed over the entire ground engaging surface of the sole portion 420, but may be disposed over a portion or portions of the sole portion 420. For example, one portion may be the portion corresponding to the position of the ball of the wearer's foot in use, and another portion may be the portion corresponding to the position of the heel of the wearer's foot in use.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore; the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the footwear manufacturing industry.

The claims defining the invention are as follows:

1. A footwear, comprising:

a sole;

an upper secured to the sole, the upper defining at least a front portion;

an apron portion having first and second lateral portions and a lower end, each of the first and second lateral portions comprising a free lateral outer edge, the apron portion being attached at the lower end to the front portion; a first fastening means for releasably connecting the first and second lateral portions together, the first fastening portion being configurable between a fastened position in which the first and second lateral portions are held adjacent one another, and an unfastened position in which at least an upper portion of each of the first and second lateral portions, respectively, can be readily separated, wherein the apron portion has an upper end, and the first fastening means extends from the upper end to the lower end, wherein the first fastening means is a zip fastening means;

the footwear further comprising a flap portion to secure the footwear to the foot of the wearer in use when the first fastening position is in the unfastened position, and wherein the apron portion is flexible to enable an opening of the footwear to be widened when the first fastening portion is in the unfastened position.

2. The footwear as claimed in claim 1, the zip fastening means having first and second tapes, each tape being attached to opposing lateral inner edges of the first and second lateral portions, respectively, and each tape comprising a plurality of coupling elements located along the tape, and a pull tab being adapted to meshingly engage the plurality of coupling elements when the zip fastening means is in the fastened position and to disengage the plurality of coupling elements when the zip fastening means is in the unfastened position.

3. The footwear as claimed in claim 1, wherein the first fastening means includes any one of the following complementary fastening means: a hook and loop fastening means, a press stud fastening means, a buckle fastening means, a button and loop fastening means, and a lace fastening means.

4. The footwear as claimed in claim 1, wherein the upper further defines first and second lateral sides and one of the first and second lateral sides comprises the flap portion being configurable between an open position in which the flap portion is disengaged from the other of the first and second lateral sides and a closed position in which the flap portion is releasably engaged with the other of the first and second lateral sides.

5. The footwear as claimed in claim 4, further comprising a second fastening means having a first complementary part mounted to the flap portion and a second complementary part mounted to the other of the first and second lateral sides.

6. The footwear as claimed in claim 5, wherein the second fastening means includes any one of the following complementary fastening means: a hook and loop fastening means, a press stud fastening means, a buckle fastening means, and a button and loop fastening means.

7. The footwear as claimed in claim 1, further comprising a tongue portion attached to the upper portion of one of the first and second lateral portions.

* * * * *